United States Patent [19]

Reich

[11] Patent Number: 4,726,265

[45] Date of Patent: Feb. 23, 1988

[54] GRIPPING PLIERS WITH AN ATTACHED GROOVED SLIP JOINT

[75] Inventor: Rolf Reich, Neustadt, Fed. Rep. of Germany

[73] Assignee: Harry P. Will Werkzeugfabrik GmbH & Co. KG, Neustadt, Fed. Rep. of Germany

[21] Appl. No.: 903,892

[22] Filed: Sep. 5, 1986

Related U.S. Application Data

[63] Continuation of Ser. No. 683,817, Dec. 20, 1984, abandoned.

[30] Foreign Application Priority Data

Dec. 23, 1983 [DE] Fed. Rep. of Germany ..... 3346700

[51] Int. Cl.[4] ..... B25B 7/04

[52] U.S. Cl. ..... 81/411; 81/407; 81/416

[58] Field of Search ..... 81/385, 386, 392, 394, 81/411, 414, 415, 416, 407

[56] References Cited

FOREIGN PATENT DOCUMENTS 2619651 11/1977 Fed. Rep. of Germany ..... 81/394

*Primary Examiner*—Frederick R. Schmidt
*Assistant Examiner*—Bradley I. Vaught
*Attorney, Agent, or Firm*—Max Fogiel

[57] ABSTRACT

Gripping pliers with an attached grooved slip joint, with a slot provided in one plier leg and intended for receiving with variable positioning the hinge bolt located in the other leg, in which the grooves, notches or the like safeguarding the setting of the pliers are provided in a strip arranged laterally next to the slot on the sliding surface of the first plier leg, and the other plier leg has on its sliding surface stops interacting with this strip and limiting the closing and opening of the pliers.

7 Claims, 6 Drawing Figures

GRIPPING PLIERS WITH AN ATTACHED GROOVED SLIP JOINT

This application is a continuation of application Ser. No. 683,817, filed Dec. 20, 1984, now abandoned.

BACKGROUND OF THE INVENTION

The invention relates to gripping pliers with an attached grooved slip joint according to DIN 5231, previously also called water-pump pliers. Such pliers have already been known for a long time. Depending on their design, they allow a number of possible adjustments to be made. However, they have the disadvantage that in the rear adjustment positions the plier handles meet one another, and that, when a load is exerted on the pliers, it is possible for them to jump from one adjustment position to another and consequently slip off from the particular workpiece which is grasped, and this always results in injuries caused when the fingers or the inner surface of the hand are crushed. This can only be prevented on pliers with an inserted slip joint, but because of their complicated design these are much more difficult to produce and are therefore considerably more expensive.

SUMMARY OF THE INVENTION

The object of the invention is to avoid the disadvantages of the known gripping pliers and provide pliers with an attached grooved slip joint, in which slipping off from the workpieces grasped and injury to the workman concerned are prevented from the outset and which are simple and cheap to produce and maintain.

This is achieved, according to the invention, because the grooves, notches or the like safeguarding the setting of the pliers are provided in a strip arranged laterally next to the slot on the sliding surface of one leg of the pliers, and the other leg of the pliers has on its sliding surface stops interacting with this strip and limiting the closing or opening of the pliers.

Preferably, the strip is extended beyond the grooves, notches or the like towards the handle of the pliers, and the stop interacting with the stop strip is designed or arranged in such a way that it allows the plier handles to close only to the extent that there still remains a safety distance, so that from the outset there is no possibility of any injuries.

According to the invention, the stops limiting the closing or opening of the pliers are formed by means of a portion cut out or milled out from the sliding surface provided on the particular leg of the pliers, a passage corresponding to the width and height of the stop strip being formed between the arcuate rib engaging into the stop strip and the stops.

At the same time, the stop strip can appropriately be provided on the sliding surface of the leg of the pliers which has the slot, whilst the stops limiting the opening and closing of the pliers as well as the arcuate rib are provided on the sliding surface of the other leg of the pliers which receives the hinge bolt.

BRIEF DESCRIPTION OF THE DRAWINGS

The idea of the invention allows a wide variety of possible designs. A particularly appropriate embodiment is illustrated in the attached drawings in which.

DESCRIPTION OF THE PREFERRED EMBODIMENT

Figure 1:
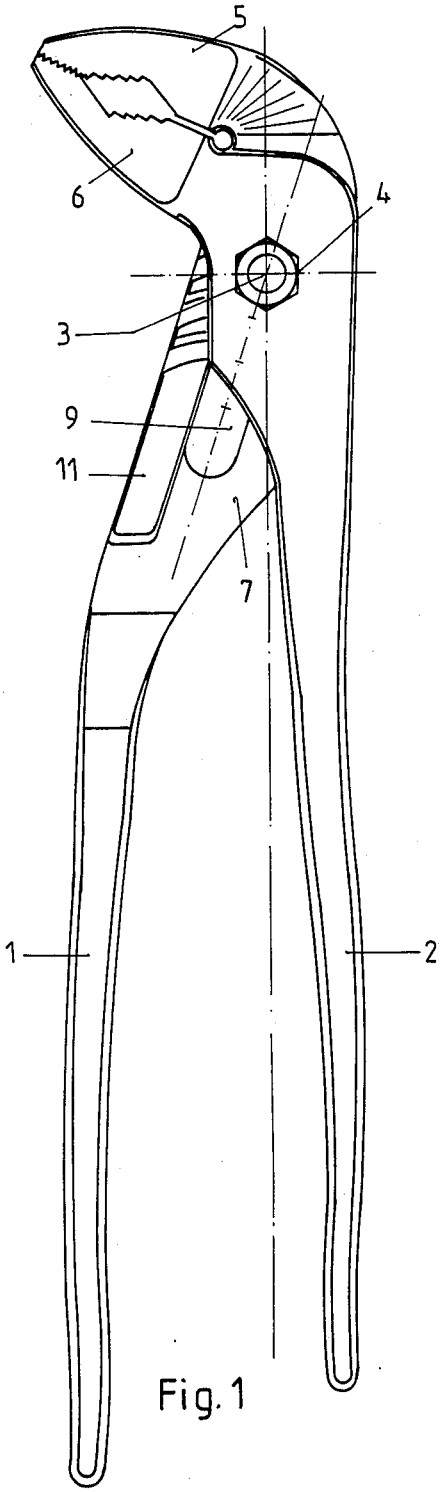
FIG. 1 shows a view of the gripping pliers according to the invention when closed.
Figure 2:
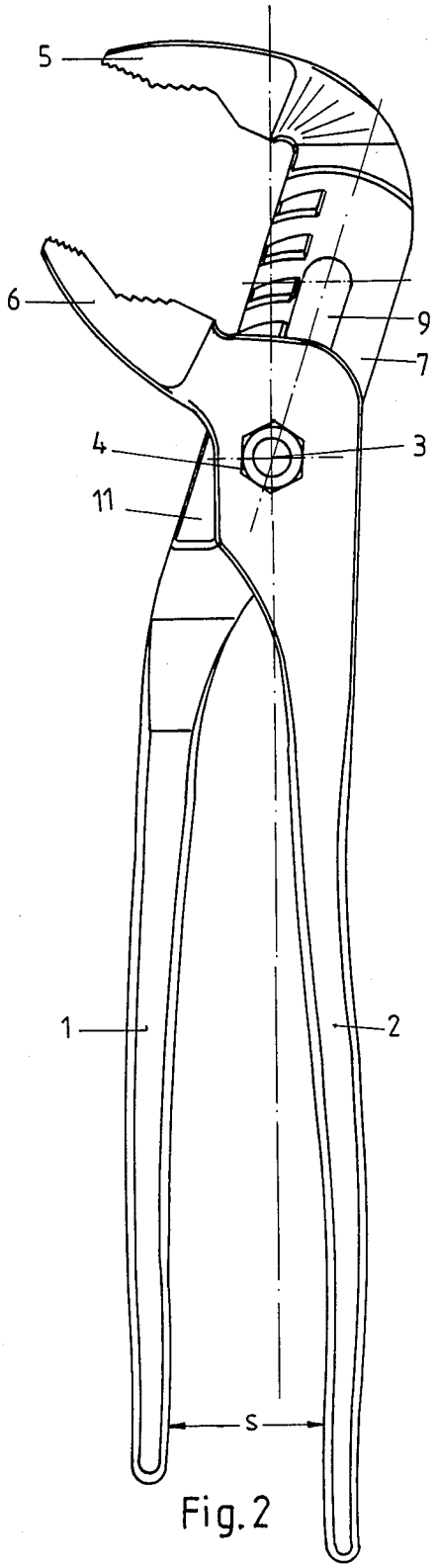
FIG. 2 shows a view of the pliers according to FIG. 1 when opened.
Figure 3:
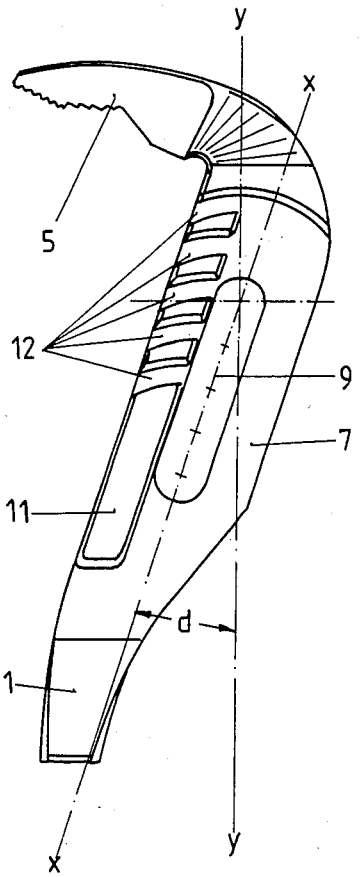
FIG. 3 shows a view of the sliding surface of the leg of the pliers which is provided with the slot.
Figure 4:
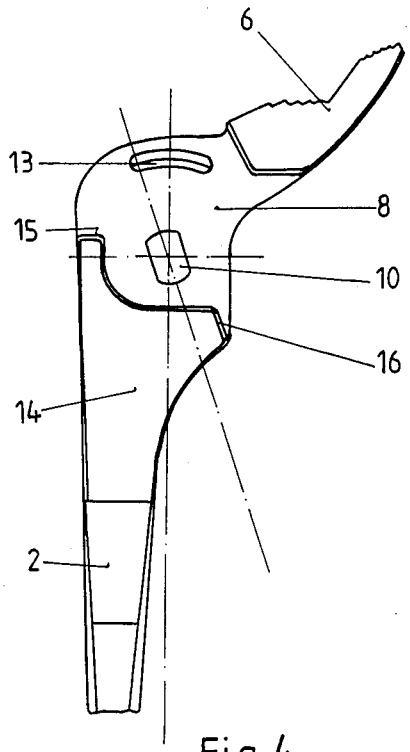
FIG. 4 shows a view of the sliding surface of the other leg of the pliers.

The gripping pliers illustrated according to the invention have two plier legs which have a handle 1, 2 and are articulated to one another via a hinge bolt 3 with a nut 4. The plier handles 1 and 2 are curved conventionally and, depending on the design, are smooth, roughened or provided with a PVC coating or a handle sheath. The plier jaws 5 and 6 can be of any design, depending on the intended use of the pliers.

The two plier legs are connected via a so-called slip joint, a sliding surface 7, 8 being provided in the slip-joint region between the handle and each of the plier jaws. In the sliding surface 7 of the plier leg 1, 5 there is a slot 9, and in the plier leg 2, 6 there is a profiled bore 10 for receiving and securing the hinge bolt 3 which is displaceable in the slot together with the plier leg 2, 6.

Arcuate notches 12 are provided in the upper part of a strip 11 which rests on the sliding surface 7 immediately next to the slot 9.

Figure 5:
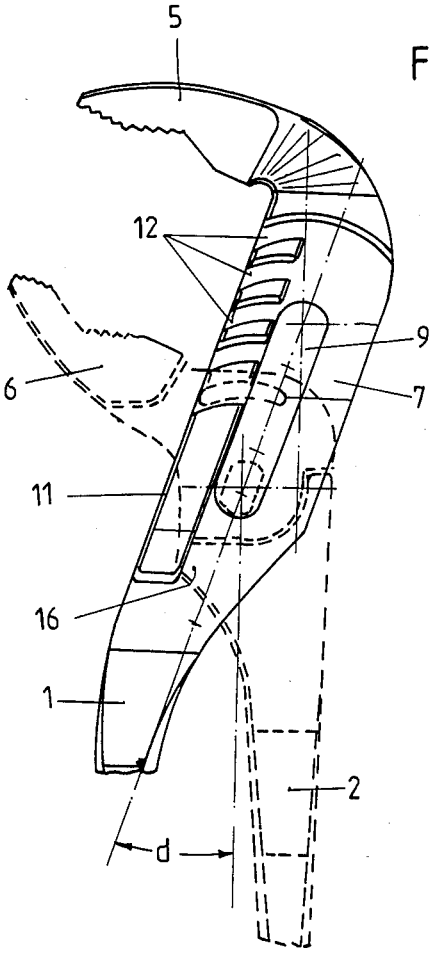
FIGS. 5 and 6 show diagrammatic representations of the head of the pliers in different working positions.
Figure 6:
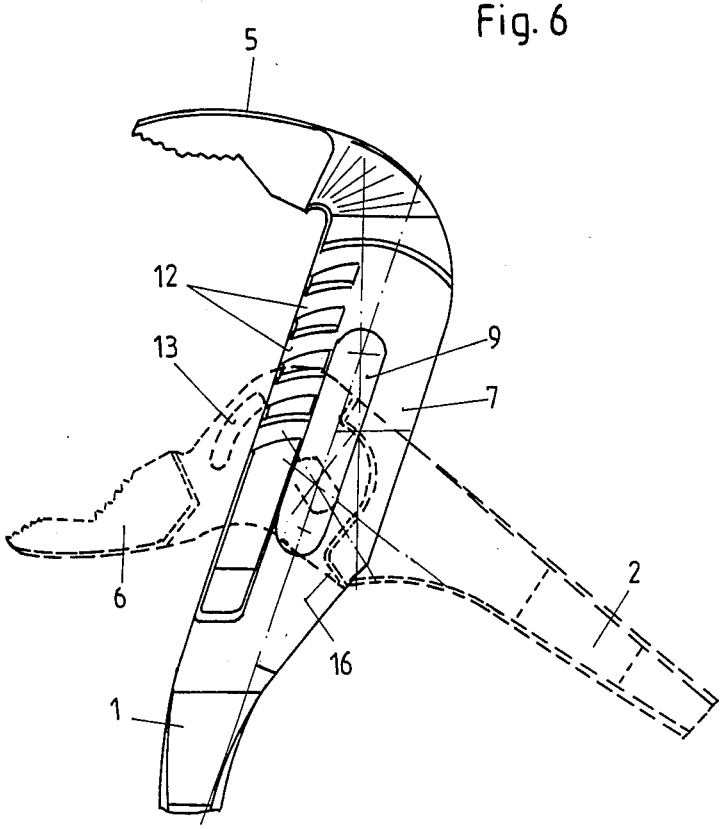

An arcuate rib 13 and an attachment 14, cut out in the form of an arc and ending in stops 15, 16, are located on the sliding surface 8 of the other plier leg 2, 6. A sufficiently large free space is left between the arcuate rib 13 and the stops 15, 16 to make it possible, in an appropriate angular position of the plier legs, to displace the latter relative to one another in the longitudinal direction, in order to vary the gripping range of the pliers. As a result of pivoting, that is to say when the pliers are closed, the arcuate rib 13 penetrates into one of the notches 12, as a result of which the pliers are secured in their new setting. In all cases, the closing movement of the plier legs is limited, because the stop 16 comes up against the stop strip 11, as shown by broken lines in FIG. 5. On the other hand, however, the stop 15 can also be used, when the pliers are opened wide, to limit the opening movement by coming up against the stop strip 11. The extension of the stop strip 11 towards the handle of the pliers always ensures that in any adjustment position, when the pliers are closed, the plier handles can be moved towards one another only to such an extent as to avoid injuries caused when the handles of pliers approach one another too closely. A safety distance S always remains between the plier handles. This is achieved when, for example, the dimensions of the stop strip and stops are such that an angle d of 18° to 20° remains between the adjustment axis XX and the centre axis YY of the pliers.

I claim:

1. Gripping pliers with jaws and with a grooved slip joint, comprising: a first plier leg with a slot; a second plier leg with a hinge bolt extending into said slot for variable positioning of said jaws; a substantially flat strip on said first plier leg adjacent only one side of said slot; said strip only having grooves for safeguarding setting of the pliers at variable positions; said strip being located on a sliding surface of said first plier leg and being raised above said sliding surface; said second plier leg having a sliding surface cooperating with the sliding surface on said first leg; stop means on said sliding surface on said second leg interacting with said strip for limiting the closing and opening of the pliers; said stop means being raised above said sliding surface on said second leg to a height corresponding to the height of said grooves on said strip.

2. Gripping pliers as defined in claim 1, including an arcuate rib on the sliding surface on said second leg, said sliding surface on said second leg having a cut-out portion forming said stop means; said stop means limiting closing and opening of the pliers by said stop means, a passage corresponding to width and height of said strip being formed between said arcuate rib engaging into said strip and said stop means.

3. Gripping pliers as defined in claim 1, including a handle portion on said pliers, said strip extending beyond said grooves and towards said handle portion.

4. Gripping pliers as defined in claim 1, wherein said stop means prevents said pliers from closing beyond a predetermined safety distance.

5. Gripping pliers as defined in claim 1, including an arcuate rib on the sliding surface of said second leg, said stop means limiting opening and closing of the pliers as well as said arcuate rib being located on the sliding surface on said second leg having said hinge bolt.

6. Gripping pliers with jaws and with a grooved slip joint, comprising: a first plier leg with a slot; a second plier leg with a hinge bolt extending into said slot for variable positioning of said jaws; a substantially flat strip on said first plier leg adjacent only one side of said slot; said strip only having grooves for safe guarding setting of the pliers at variable positions; said strip being located on a sliding surface of said first plier leg and being raised above said sliding surface; said second plier leg having a sliding surface cooperating with the sliding surface on said first leg; stop means on said sliding surface on said second leg interacting with said strip for limiting the closing and opening of the pliers; handle means on said pliers, said strip extending beyond said grooves and towards, said handle means; said stop means interacting with said strip for preventing closing of said pliers beyond a predetermined safety distance; the sliding surface on said second leg having a cut-out portion, said stop means limiting closing and opening of the pliers and being formed by said cut-out portion on said second leg; an arcuate rib, a passage corresponding to width and height of said strip being formed between said arcuate rib engaging into said strip and said stop means; said stop means being raised above said sliding surface on said second leg to a height corresponding to the height of said grooves on said strip.

7. Gripping pliers with jaws and with a grooved slip joint, comprising: a first plier leg with a slot; a second plier leg with a hinge bolt extending into said slot for variable positioning of said jaws; a substantially flat strip on said first plier leg adjacent only one side of said slot; said strip only having grooves for safeguarding setting of the pliers at variable positions; said strip being located on a sliding surface of said first plier leg and being raised above said sliding surface; said second plier leg having a sliding surface cooperating with the sliding surface on said first leg; stop means on said sliding surface on said second leg interacting with said strip for limiting the closing and opening of the pliers; handle means on said pliers, said strip extending beyond said grooves and towards, said handle means; said stop means interacting with said strip for preventing closing of pliers beyond a predetermined safety distance; the sliding surface on said second leg having a cut-out portion, said stop means limiting closing and opening of the pliers and being formed by said cut-out portion on said second leg; an arcuate rib, a passage corresponding to width and height of said strip being formed between said arcuate rib engaging into said strip and said stop means; said stop means comprising edges oriented angularly relative to each other; said stop means being raised above said sliding surface on said second leg to a height corresponding to the height of said grooves on said strip.

* * * * *